United States Patent [19]

Nocek et al.

[11] Patent Number: 4,791,710

[45] Date of Patent: Dec. 20, 1988

[54] SELF-ALIGNING CLOSABLE EXTRUDED PROFILE PLASTIC FASTENER AND METHOD

[75] Inventors: Robert S. Nocek, Stamford, Conn.; Paul A. Tilman, New City, N.Y.; George Rasko, Fair Lawn, N.Y.; Steven Ausnit, New York, N.Y.

[73] Assignee: Minigrip, Inc., Orangeburg, N.Y.

[21] Appl. No.: 29,268

[22] Filed: Mar. 23, 1987

[51] Int. Cl.[4] ..... A44B 19/14

[52] U.S. Cl. ..... 24/587; 24/90 E; 24/400; 383/63; 383/65

[58] Field of Search ..... 24/587, 576, 399, 400, 24/90 E, 704, 16 PB, 30.5 P; 383/9, 35, 63, 65

[56] References Cited

U.S. PATENT DOCUMENTS

| | | | |
|---|---|---|---|
| 2,606,351 | 8/1952 | Wende | 24/400 |
| 2,975,496 | 3/1961 | McGraw | 24/587 |
| 3,425,469 | 2/1969 | Ausnit | 24/587 |
| 3,440,696 | 4/1969 | Staller | 24/587 |
| 3,715,781 | 2/1973 | Salvatori | 24/90 E |
| 3,808,649 | 5/1974 | Ausnit | 383/63 |
| 4,290,467 | 9/1981 | Schmidt | 383/65 |
| 4,317,262 | 3/1982 | Wells, Jr. | 24/16 PB |
| 4,501,049 | 2/1985 | Adamson | 24/30.5 P |
| 4,572,466 | 2/1986 | Yamaguchi et al. | 24/16 PB |
| 4,662,033 | 5/1987 | Wieland, Jr. et al. | 24/90 E |

FOREIGN PATENT DOCUMENTS

| | | | |
|---|---|---|---|
| 2656045 | 6/1978 | Fed. Rep. of Germany | 24/587 |
| 1047928 | 11/1966 | United Kingdom | 24/400 |
| 1128475 | 9/1968 | United Kingdom | 24/400 |

*Primary Examiner*—Victor N. Sakran

*Attorney, Agent, or Firm*—Hill, Van Santen, Steadman & Simpson

[57] ABSTRACT

A method and structure for a non-reopening extruded plastic profile fastener wherein complementary rib and groove type profiles are constructed and arranged to be pressed into interlocking relationship, and provided with restraining means against permanent interlocking so that the fastener can be handled as an assembly with the profiles aligned for interlocking but not interlocked until the means are overridden and the profiles pressed into interlocked relation with one form of the overridable means being a frangible diaphragm across the groove to prevent movement of the rib and in another form a projecting strut which is yieldable with the application of a predetermined force or which is removable to permit the profiles to be moved to fully interlocked position.

9 Claims, 2 Drawing Sheets

SELF-ALIGNING CLOSABLE EXTRUDED PROFILE PLASTIC FASTENER AND METHOD

BACKGROUND OF THE INVENTION

The present invention relates to improvements in flexible extruded plastic fasteners having interlocking complementary profiles constructed and arranged to be pressed into interlocked relation.

Flexible extruded plastic profile fasteners are normally provided with a rib element which is arranged to be pressed into interlocking relationship into a groove element. The fasteners are commonly used on bags and pouches but also find utility in attaching two mating parts, such as attaching a sheet of plastic to another sheet of plastic. While structures frequently adopted permit pressing the complementary profiles together to interlock them and permit forcible separation by pulling the profiles apart, profiles have been found to be quite expedient as a means for a simplified permanent fastener. Such fasteners may be used in a structure such as at the top of a container where the container is to be filled and thereafter permenently sealed. The container will be openable by other means, such as tearing open the top, or on occasion by separating the profiles by a special tool. In each case means are provided for retaining the interlocked profiles substantially against separation. U.S. Pat. No. 3,808,649 relates to a non-reopenable construction which requires a tool for interlocking the profiles. U.S. Pat. No. 4,290,467 discloses an interlocked profile construction wherein the profiles are difficult to open from the outside of the bag because of the closely trimmed flanges at the outside of the zipper. Other means may be employed to essentially permanently interlock the profiles, such as utilization of an adhesive or heat welding the profiles together. The present invention pertains principally to arrangements for an improved structure wherein the profiles are designed to be essentially permanently interlocked.

In connection with the use and handling of profiles which have a permanent interlocking feature, it is desirable that the profiles can be handled and stored without becoming interlocked prior to usage. For example, if the profiles are to form a permanent closure for the top of a bag, it is necessary that the bag can be handled and stored such as by stacking in a container without the profiles becoming closed because they cannot be simply reopened. If the profiles inadvertently become interlocked through the application of small pressure such as encountered in stacking a number of bags or in handling them, the bags become unusable because they cannot be filled without some special arrangement for opening them, and this become impractical for bags for commercial use.

It is accordingly an object of the present invention to provide a method and structure for interlocking profiles wherein the closure profiles can sustain the forces of normal handling and storage without accidentally becoming interlocked.

A further object of the invention is to provide a complementary profile structure having an arrangement wherein they can be forcibly pressed to permanent interlocking relationship, but normal processing, handling and storage forces do not cause interlocking of the profiles.

In the provision of interlocking profiles, it is economically expedient to manufacture the profiles that do not use more plastic than necessary. The size and design of the profile is governed by the minimum amount of plastic needed to provide a strength which will prevent accidental tearing or reopening of the profiles through normal handling and usage of the filled bag. To provide more plastic or heavier parts than are needed for the essential nonopening function increases the expense unnecessarily and obtains a more weighty and bulky structure than needed. With reliable designs which obtain permanently interlockable rib and groove profiles, the profiles can be made of a relatively small size and still provide adequate strength for their purpose. A difficulty with such a small size is that it is essential that the rib and groove profiles be kept in alignment so that they will interlock when pressed together. This alignment is hard to maintain with very small profiles when the fastener may sustain considerable handling prior to use and during filling.

It is accordingly an object of the present invention to provide an improved structure which maintains the profiles in alignment until they are permanently interlocked and insures that the rib element will be in the proper location relative to the groove element to readily interlock when a sufficient closing pressure is applied.

In accordance with features of the invention, the structure of the rib and groove element is such that the rib at all times will remain positioned opposite the groove element at one location so that when the application of a progressive pressure is applied to join the rib and groove element, they will readily and immediately join. With the use of automatic equipment, this reliability of joining becomes essential because if the two closure elements get out of alignment and a closing pressure is applied, they will not join and a reject will occur. That is, the rib and groove will not interlock and substantial difficulty is encountered in trying to get them back into alignment or as an alternative, the bag and its contents will have to be discarded. It is also important that interlocking reliably occur because bags cannot be sent out into the marketplace which are not properly closed, and this is particularly essential with rib and groove elements where they are permanently joined once they are pressed to closed relationship.

Other objects, advantages and features will become more apparent with the teaching of the principles of the present invention in connection with the disclosure of the preferred embodiments thereof in the specification, claims and drawings, in which:

DESCRIPTION OF THE PREFERRED EMBODIMENTS

Figure 1:
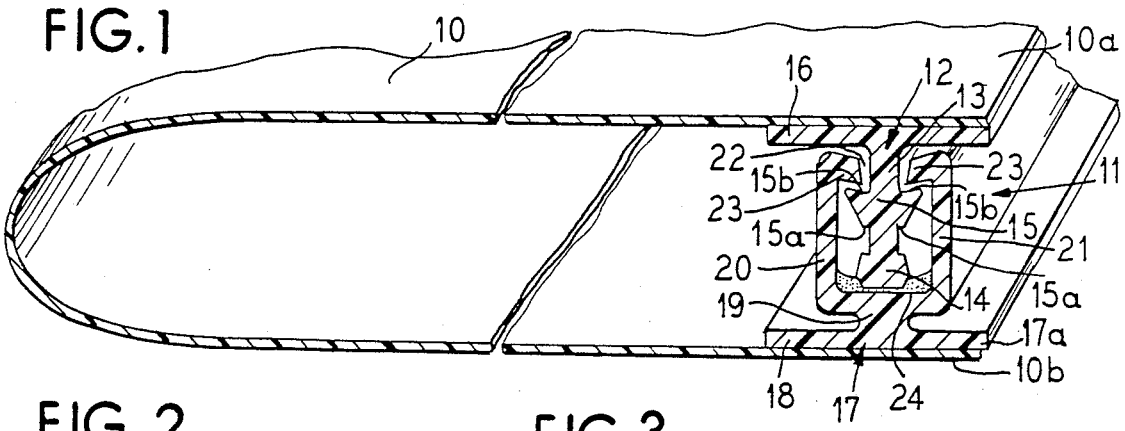
FIG. 1 is a fragmentary sectional view taken through a bag illustrating a closure at the top of the bag constructed in accordance with the principles of the present invention and with the dimensions of the elements of the closure being exaggerated in size for purposes of illustration.
Figure 2:
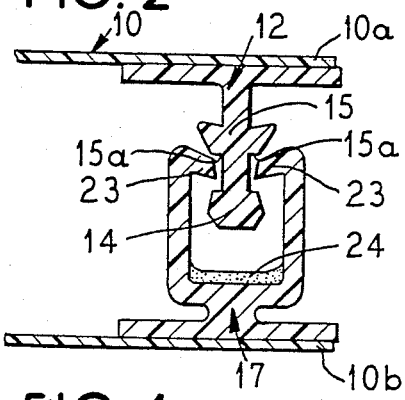
FIG. 2 is a fragmentary view of the closure elements of the structure of FIG. 1 illustrating the elements moved to a first relative position where they are in alignment but not yet closed, in FIG. 1 illustrating the elements in their closed permanently locked position.

FIGS. 1 and 2 illustrate a bag 10 of thin flexible plastic or like material with top edges 10*a* and 10*b*. To close the top of the bag, preferably in a permanent fashion, an elongated flexible closure zipper 11 is attached to the confronting faces of the top edges 10*a* and 10*b*. The fastener has complementary profiles 12 and 17 which are constructed and arranged to be pressed together into interlocked relation. FIG. 1 shows the profiles in their permanently interlocked relation. FIG. 2 shows the profiles being held in alignment so that they will interlock when pressed together, but in FIG. 2 they have not yet been forcibly pressed together but as indicated, are merely held aligned and are constructed so that normal storage and handling forces will not permanently join and interlock the profiles.

The profiles include a rib member 12 extending along the length of the fastener and which has a flat web base 16 that is welded such as by adhesive or heat seal to the top edge 10*a* of the bag. A bag commonly of thin polyethylene may be employed and the profile 12 can be constructed of the same material or a stiffer plastic having the physical characteristics particularly suitable for a permanently interlockable fastener.

The rib or male profile 12 has a stem 13 with an outer or distal head 14. The outer head is constructed with rounded edges so as to comfortably set in at the ends of the groove element to maintain the elements 12 and 17 in alignment. Where the bag 10 is a flat bag, the ends will be joined to each other and the fastener elements 12 and 17 will be separable at the center but will be interlocked and held together at the ends, such as by a spot heat seal.

As illustrated in FIGS. 1 and 2, the stem 13 of the male profile also carries a second larger head 15 of generally arrow shaped cross section and which operates to retain the semi-interlocked profiles substantially against complete interlocking. That is, the head 14 is an aligning head to align the male profile with the female profile 17 while not fully interlocked and maintain it in alignment. The head 15 will then function to interlock the profiles and to assist in permanently joining them.

The female profile 17 which also extends along the length of the fastener has a base 18 which is secured to the top edge 10*b* of the bag by adhesive or heat sealing and a short stem 19 supports side jaws 20 and 21 which define a groove 22 therebetween for receipt of the male profile. At the outer ends of the jaws are hooks 23 which have inner surfaces to engage with and lock against locking shoulders 15*b* of the head 15 when the profiles are in permanent interlocked relationship as shown in FIG. 1.

The head 15 has minor shoulders 15*a* which initially restrain entry of the head 15 into the groove 22. Additional pressure, however, will force the head 15 into the groove until where the head forces its way past the jaws of the female profile 17 to the positional relationship of FIG. 1. The design of the structure is such that the jaws 23 have sufficient strength to snap past the head 15 and lock behind the shoulders 15*b* to assist in permanently interlocking the profiles, along with the principal permanent interlocking means which will consist of a combination of any two of three possible features, namely, one or more retaining ribs on one or either side of the male profile, an offset stem on the female profile or an adhesive layer 24 located inside and at the bottom of the female profile groove. This forms an essentially permanent fastener for the top of the bag. The bag would be opened only by cutting off the top or in some instances, a special tool could be provided which would force apart the jaws 20 and 21 so that the fastener could be opened, if no adhesive is used in the base of the female profile groove.

Figure 3:
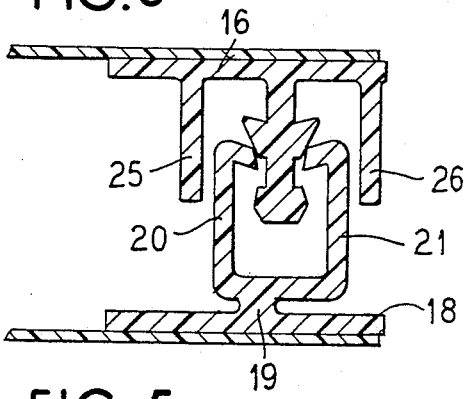
FIG. 3 is an illustration of a somewhat modified form of interlocking profile structure employing elements similar to that shown in FIGS. 1 and 2.

In operation, the profile after being extruded, is aligned as in FIGS. 2 or 3 and is spooled. Under such circumstances the construction indicated will keep the profile aligned but prevent permanent closure. Alternatively, the male and female profiles could be spooled separately. Thereafter, the aligned profiles are unwound (and if spooled separately, realigned) and attached onto film in a pouch forming machine. As the pouch is formed, cross-seals are made which force the male profile into permanent interlocking relationship with the female profile with the female profile at the edges of the pouch by overcoming the resistance of the restraining means. However, across the rest of the pouch the profiles remain aligned, but not permanently closed. The profiles can then be pulled apart away from each other to open the top of the bag for filling, and when filling is completed, the complementary profiles can be pressed into interlocking relation by applying sufficient pressure along the length starting at the ends, where the profiles are aligned. This pressure will force the head 15 between the jaws and the parts will move to the relative interlocked position shown in FIG. 1. While the advantages of the structure are primarily intended for use with a fastener which has means for retaining the interlocked profiles substantially against separation, in certain circumstances a separable rib and groove profile structure may be employed, still utilizing the feature of the outer head 14 which holds the profiles in alignment at the ends, and the feature of the inner head 15 which provides for holding the profiles together when pressed to interlocked relation but permits reopening, because permanent closing means are not used.

In the modified arrangement of FIG. 3, outer prongs 25 and 26 are provided. These prongs are positioned closely adjacent the jaws 20 and 21 of the female profile and strengthen or reinforce the cantilever strength of the jaws to hold them more tightly against the stem of the male profile to lock the hooks 23 of the jaws against the base of the head 15. Also, these prongs react with the base 17 of the female profile to prevent separation of the interlocked elements. In addition, the offset neck 19 further reinforces the resistance to separation of the profiles.

Figure 4:
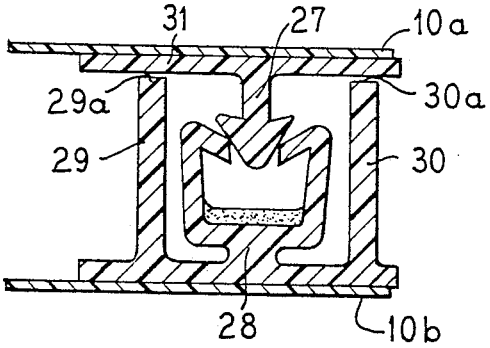
FIG. 4 is a sectional view of complementary profiles of a modified construction.
Figure 5:
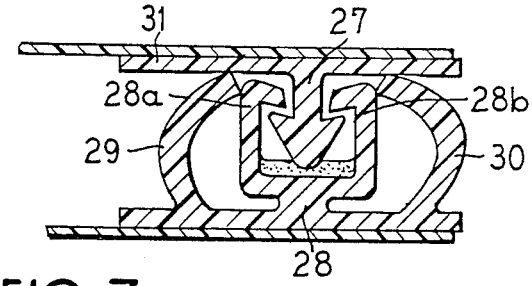
FIG. 5 is a sectional view of the elements of FIG. 4 illustrating the relationship of the parts when the elements are pressed into interlocked relation.

In the arrangement of FIGS. 4 and 5, a different overridable means is provided for initially restraining the profiles against interlocking. The fastener of FIGS. 4 and 5 has a female profile 28 and a male profile 27 which interlock when pressed together to the position of FIG. 5. During normal handling and storage, the head of the rib or male profile 27 is prevented from entering the groove of the female profile 28 by outer ends of prongs 29 and 30 abutting against the base 31 of the rib element 27. The outer ends 29*a* and 30*a* of the prongs are of such a length that they will not permit the head of the rib element to enter the groove unless the prongs 29 and 30 are bent in the manner shown in FIG. 5. Thus, normal handling pressures will not accommodate interlocking of the rib and groove profiles.

However, when a predetermined interlocking force is applied forcing the rib into the groove, the prongs 29 and 30 will bend in the manner shown in FIG. 5 allowing the rib to move to interlocked position. In this structure, preferably the rib and grooves are constructed so that they are retained against separation by additional means such as an adhesive at the base of the female profile. This construction will be augmented by the prongs 29 and 30 which are designed so that they will bow inwardly toward the groove element as shown in FIG. 5 and provide a supporting strut against the legs 28*a* and 28*b* of the grooved profile. As will be seen in FIG. 5, the prongs will essentially wedge themselves between the jaws 28*a* and 28*b* of the groove element and the base 31 of the rib element.

Figure 7:
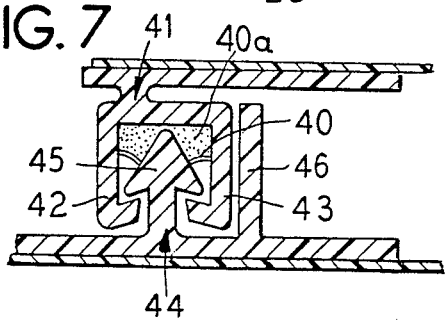
FIG. 7 is a sectional view showing the profiles of FIG. 6 pressed to interlocked relation.
Figure 8:
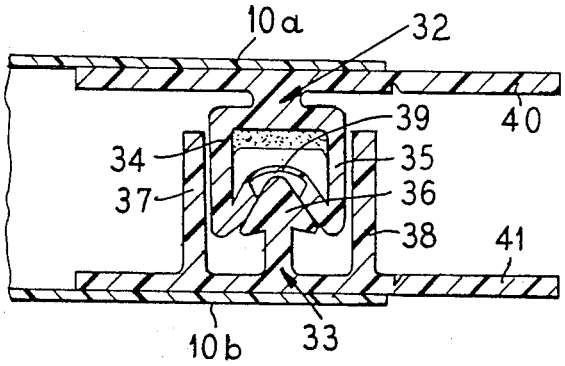
FIG. 8 is a sectional view of another form of interlocking profiles illustrating the elements before they are pressed to interlocked relationship.
Figure 9:
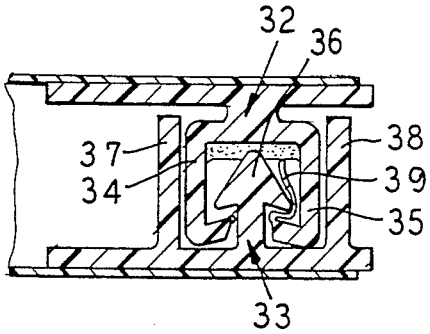
FIG. 9 is a sectional view of the profiles of FIG. 8 illustrating their position when they are pressed to be interlocked.

FIGS. 8 and 9 illustrate another form of fastener wherein overridable means is provided for initially restraining the profiles against interlocking so that the fastener can be handled as an assembly but not interlocked until the means are overridden and the profiles pressed into interlocked relation. The overridable means is in the form of a frangible diaphragm 39 which will initially be described in connection with FIGS. 8 and 9 and thereafter described in another form in connection with FIGS. 6 and 7.

In FIGS. 8 and 9, a female element 32 is provided attached to the top edge 10*a* of a bag and a male element 33 is provided attached to the top edge 10*b*. It will be fully understood and appreciated by those versed in the art that the male and female element may be reversed and either one attached to either edge of the bag top.

In the arrangement of FIGS. 8 and 9, the profiles are shown as initially restrained against interlocking in FIG. 8 and as interlocked with the means for restraining overridden in FIG. 9. When the profiles are interlocked, a head 36 of the male profile 33 is forced in between the jaws 34 and 35 of the female profile 32. The profile arrangement is preferably such that means are provided for retaining the profile substantially against separation and this is accomplished, in one way, by the rigidity of the jaws 34 and 35 and supporting outer prongs 37 and 38 which support the jaws 34 and 35 in their interlocked relationship with the head 36 of the male element.

As the fastener first exists before interlocking, the head 36 cannot enter between the jaws of the female element because of overridable means 39 which is a diaphragm bridging the ends of the jaws. The diaphragm, in one form, is as a thin plastic film which can be extruded at the same time as the profiles are extruded. When the profiles are to be permanently interlocked, a predetermined force overrides the overridable diaphragm 39 fracturing it and pushing it to one side as shown in FIG. 9. The diaphragm does not substantially interfere with the interlocked relationship of the parts but does function fully satisfactory to prevent entry of the head into the groove with normal handling and storage pressures applied to the profiles.

Figure 6:
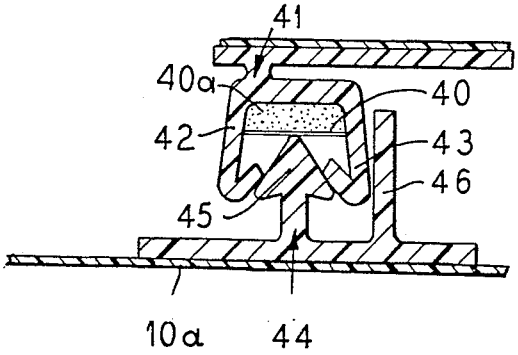
FIG. 6 is a sectional view illustrating another form of complementary interlocking profiles.

In the arrangement of FIGS. 6 and 7, a similar frangible diaphragm 40 is employed which extends between the jaws 42 and 43 of a female profile element 41. In the arrangement shown, the diaphragm is placed further into the slot between the jaws 42 and 43 rather than being bridged across between the hooks of the jaws as it is in FIGS. 8 and 9. A male element 44 has a head 45 which is pressed between the jaws to fracture the diaphragm 40 when the profiles 41 and 44 are to be interlocked as they are shown in FIG. 7. The diaphragm 40 also retains a liquid adhesive or sealer which permanently seals against the head 45 when it fully enters the slot, and which was extruded or applied inside the female profile either before or together with the diapgragm. Alternately the diaphragm could consist of a skin which forms on the adhesive.

A single prong 46 projects up beside one of the jaws 43 to support it and add to the strength of the means for retaining the interlocked profiles against separation.

The frangible diaphragm 40 will prevent permanent locking until the bag is to be permanently closed and when a predetermined pressure is applied, the diaphragm 40 will be broken permitting the head 45 of the male element to fully enter the groove of the female element to be locked therein held substantially against separation in the manner illustrated in FIG. 7.

Figure 10:
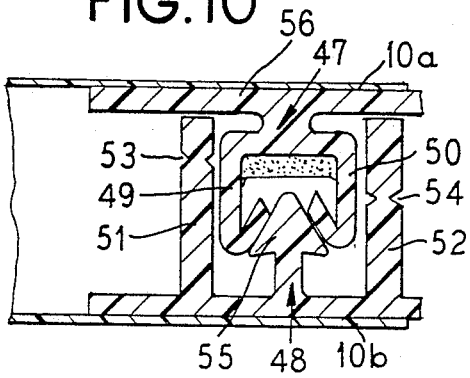
FIG. 10 is a sectional view of a profile structure of another construction illustrating the profiles before they are interlocked.
Figure 11:
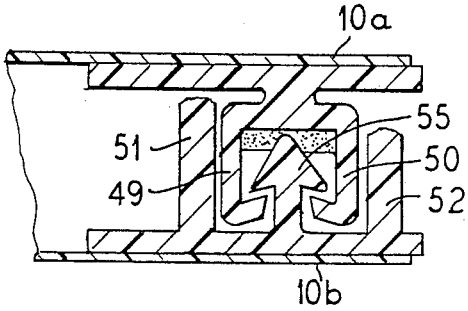
FIG. 11 is a sectional view of the profiles of FIG. 10 illustrating them after they have been interlocked.

In the structure of FIGS. 10 and 11, a groove element 47 is attached to the top edge 10*a* of a bag and a rib element 48 is attached to the outer edge 10*b*. The groove element has jaws 49 and 50 which receive a head 55 of the rib element when the profiles are interlocked as shown in FIG. 7.

Prior to interlocking, overridable means are provided for initially restraining the profiles against interlocking in the form of rigid (as opposed to the flexible prongs illustrated in FIGS. 4 and 5) prongs 51 and 52 which are part of the rib element 48. The prongs are of a length so that they abut against a base 56 of the groove element preventing the head 55 from being pushed all the way between the jaws. However, when permanent interlocking is to be accomplished, the outer end of the prongs are removed, and for this purpose they have a notch or line of weakened resistance 53 and 54 for the prongs 51 and 52 respectively. These outer portions of the prongs are torn off so that the prongs then have the appearance shown in FIG. 11. This allows the head 55 to be forcibly pressed into the groove between the jaws 49 and 50. The prongs 51 and 52, closely spaced outside of the jaws, support them and obtain an interlocking profiled relationship which is substantially held against separation when combined with either an offset female profile neck or an adhesive layer inside the base of the female profile groove.

Figure 12:
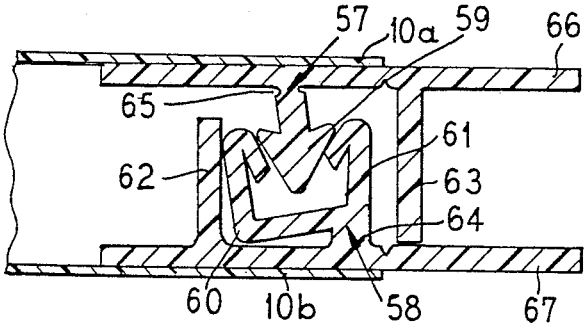
FIG. 12 is a sectional view of another form of profiles before they are interlocked.
Figure 13:
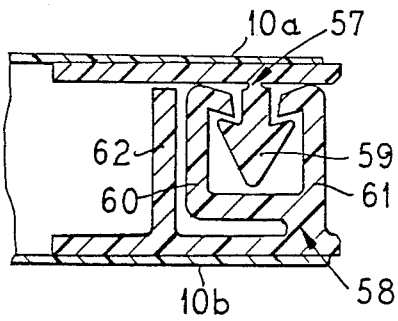
FIG. 13 illustrates the profiles of FIG. 12 after they have been interlocked.

FIGS. 12 and 13 illustrate a complementary profile structure with a rib element 57 attached to the upper edge 10*a* of a bag and a groove element 58 attached to an upper edge 10*b* of a bag. The rib element has a head 59 which enters in the groove between jaws 60 and 61 of the groove element for interlocking.

When the profiles are interlocked and restrained substantially against separation, a prong 62 supports the jaw 60 of the groove element.

A longer stiff prong 63 extends from the base of the rib element to engage the base of the groove element and prevents a head 59 of the rib element from entering between the jaws. This provides an overridable means preventing the profiles from interlocking. To prevent the profiles from separating when permanently interlocked, the groove element is mounted on a flexible offset stem 64, while the head of the rib element has a flexible stem provided by a weakened portion 65 at the base of the head. When permanent interlocking is to be accomplished, the entire top of the fastener is turn off removing flanges 66 and 67 which carry with them the permanent interlocking stiff prongs 63. The removal has been accomplished in the structure shown in FIG. 13 permitting interlocking. When the top is removed, normal pressure will cause interlocking and the rib 59 enters the groove between the jaws 60 and 61 of the groove element.

Thus, it will be seen there has been provided various arrangements of complementary profiles which are constructed and arranged to be pressed into interlocked relation. Overridable means are provided in each form for initially restraining the profiles against interlocking so that the fastener can be handled as an assembly with the profiles being aligned for interlocking but not interlocked until the means are overridden and the profiles pressed in interlocked relation. While features of the invention may be employed with the type of profiles arranged for permanent interlocking, in certain instances the means for retaining the interlocked profiles substantially against separation need not be used. While the preferred arrangement is shown in the form for closing the top of a container, other employment may be utilized for the interlockable profiles. The construction is particularly well adapted for continuous profiles which are formed by extruding from a die and the frangible diaphragms and the prongs may be formed continuously along the profiles in the same extrusion operation. This permits providing the features and advantages above mentioned without increasing the cost or time of manufacture of the fastener profiles.

I claim as my invention:

1. A non-reopening extruded plastic profile fastener of substantial length, comprising:

complementary male and female profiles extending along the length of the fastener and which are constructed and arranged to be pressed into interlocked relation;

said male profile having a rib head of generally arrow shaped cross section providing interlocking shoulders, and said female profile having a complementary groove receiving said head and having opposed hooks for interlocking engaging said shoulders;

said male profile movable toward the female profile into respective first and second positions, said profiles being in said position during stacking and handling to maintain the profiles in alignment;

means extending along the length of the fastener for retaining the interlocked profiles substantially against separation after said head is fully received in said groove in said second position; and overridable means extending along the length of the fastener for initially permitting said head to rest against said hooks in said position and restraining said profiles against movement to said second position and interlocking and also restraining the profiles against lateral displacement holding them in alignment so that the fastener can be handled as an assembly with the profiles aligned for interlocking, but not interlocked until said overridable means are overridden and the profiles pressed from said first position into permanently interlocked relation in said second position.

2. A non-reopening extruded plastic profile fastener, constructed in accordance with claim 1:

wherein said overridable means comprise shoulder means on said head facing said hooks and engageable therewith for initially restraining restraining the profiles against interlocking.

3. A non-reopening extruded plastic profile fastener, constructed in accordance with claim 1:

wherein adhesive material is located within said groove and engageable by said head for permanent retention of said head when the profiles are interlocked.

4. A non-opening extruded plastic profile fastener constructed in accordance with claim 1:

wherein said arrow shaped head has a distal head extending therefrom and releasably receivable by said hooks in the first temporary aligning but non-permanent position.

5. A non-reopening extruded plastic profile fastener, constructed in accordance with claim 1:

including limiting strut means adjacent the profiles for limiting the depth of insertion of said rib head between said hooks.

6. A non-reopening extruded plastic profile fastener, constructed in accordance with claim 5;

wherein said strut means are flexible to yield with forcible insertion of the male member into the female member.

7. A non-opening extruded plastic profile fastener constructed in accordance with claim 5:

including means for removing said strut means accommodating full insertion of the male member into the female member without resistance.

8. A non-reopening extruded plastic profile fastener, constructed in accordance with claim 5:

wherein said strut means is in the form of prongs located at each side of the profiles.

9. A non-reopening extruded plastic profile fastener, constructed in accordance with claim 8:

wherein said prongs have lines of weakened tear resistance for removal of the prongs prior to interlocking the profiles.

* * * * *